United States Patent [19]

Tartaglia et al.

[11] Patent Number: 4,992,110

[45] Date of Patent: Feb. 12, 1991

[54] WROUGHT ALUMINUM EUTECTIC COMPOSITES

[76] Inventors: John M. Tartaglia, 9071 Garrison St., Westminster, Colo. 80020; Thomas B. Cox, 2517 Vivian St., Lakewood, Colo. 80215; Daniel J. Adenis, 406 Surrey Dr., Lancaster, Pa. 17601

[21] Appl. No.: 363,840

[22] Filed: Jun. 9, 1989

[51] Int. Cl.[5] ..... C22F 1/04

[52] U.S. Cl. ..... 148/2; 148/11.5 A; 148/12.7 A; 148/415; 148/416; 148/437; 148/438; 148/440; 420/902

[58] Field of Search ..... 148/2, 11.5 A, 12.7 A, 148/415–418, 437, 438, 439, 440; 420/902

[56] References Cited

U.S. PATENT DOCUMENTS 4,126,486 11/1978 Morris et al. ..... 148/2

*Primary Examiner*—R. Dean

*Attorney, Agent, or Firm*—Hopgood, Calimafde, Kalil, Blaustein & Judlowe

[57] ABSTRACT

A method is provided for producing a wrought aluminum eutectic composite characterized by improved physical properties. The method resides in forming a casting of an aluminum alloy characterized metallographically by the presence of a eutectic structure, and then heat treating the casting at a temperature related to the eutectic-forming temperature of said alloy casting, that is just below its incipient melting point. The heat treatment is continued for a time at least sufficient to convert the morphology of the eutectic to dispersed fine particles of reinforcing phase(s), following which the alloy is physically worked to reduce the cross section thereof and provide a wrought aluminum eutectic composite characterized by improved physical properties.

7 Claims, 6 Drawing Sheets

AS-CAST x500

12 HOURS at 550 C x200

HOT ROLLED x100

HOT ROLLED + COLD ROLLED x200

WROUGHT ALUMINUM EUTECTIC COMPOSITES

This invention relates to "in situ" metal matrix composites (MMC) of aluminum-base alloys. Such alloys are metallographically characterized by the presence of a eutectic comprised of hard phases such as substantially insoluble intermetallic compounds.

BACKGROUND AND THE STATE OF THE ART

The term "in situ" metal matrix composites or MMC is used herein to distinguish such aluminum alloys from aluminum alloy composites reinforced by the physical addition of carbide or other hard particles to aluminum, such as silicon carbide, titanium carbide, alumina, $TiB_2$, and the like. The MMC alloys are generally referred to as dispersion strengthened alloys.

"In situ" or "natural" MMC are produced by taking advantage of the chemical and physical metallurgical characteristics of special alloys. This type of MMC is formed during solidification of an alloy with the proper elemental content, e.g., a eutectic or near-eutectic composition, the subject of this development. At the beginning of processing, the alloy is entirely molten and is prepared using conventional fusion metallurgy. During solidification of the alloy, the reinforcing phase forms naturally in the structure. It is only after the melt solidifies that the discrete phases of the composite can be identified in the microstructure.

A eutectic is an invariant point on the equilibrium phase diagram of an alloy containing two or more components. In a binary componant system, liquid and two solid phases can only coexist at the eutectic temperature and the eutectic composition. Each component can contain more than one element and eutectic mixtures containing more than two phases are possible.

The term eutectic used herein is meant to include near-eutectic compositions as well as all eutectic compositions. Generally speaking, these eutectic compositions will contain some amount of primary phase.

Eutectic alloys generally possess various microstructures and properties depending on how the alloy is solidified and worked. Special solidification processing techniques, such as casting under a unidirectional thermal gradient, can be employed to align a reinforcing phase in a eutectic; these directionally-solidified or aligned eutectics are highly anisotropic and have attractive properties in the as-cast state. In the present invention, no special solidification processing is employed or required; conventionally cast ingots of eutectic alloys are mechanically worked after casting to produce composite properties.

Simple static or direct-chill casting followed by rolling or extrusion of eutectic alloys is a process which is relatively inexpensive and easily adaptable to current aluminum production capability. These alloys are suited for applications where enhanced stiffness, strength, low density, and good ductility are required. The static casting and working produce sheet or bar with moderate levels of anisotropic (directional) behavior which is useful in these applications. In addition, statically-cast and worked eutectics are superplastic, for example, when hot formed at low or medium strain rates, and thus extensive forming deformation of large parts at low loads is possible without premature fracture.

There are several other advantages to producing a composite by the eutectic route which are given as follows:

The eutectic melt contains all the ingredients, e.g., no reinforcing solids must be added to the melt.

Depending on the specific phases, the interface between the matrix and reinforcing phase in an eutectic MMC is entirely coherent, or at least semicoherent and free of environmental contaminants or (interfacial) phases which can have undesirable effects on mechanical properties.

The size and spacing of the reinforcing phase in many eutectic composites is often more refined as compared to that in a conventional MMC which can have a desirable effect on strength, stiffness, and ductility.

Depending on the specific phases, the eutectic MMC can be rolled, forged, or extruded more easily than a conventional MMC containing comparatively brittle reinforcements. Also, depending on the specific phase, the reinforcement itself in the eutectic MMC will have some ductility in combination with a high modulus.

Depending on the specific matrix phase and chemistry, post solidification solution and aging heat treatment can be employed to alter the structure and properties of the eutectic composite.

So long as temperatures are not exceeded that would alter the morphology of the reinforcing phase or the matrix state of precipitation, the eutectic composites can be utilized at elevated temperatures.

One method of producing dispersion strengthened aluminum alloys is disclosed in U.S. Pat. No. 3,989,548 which issued on Nov. 2, 1976. According to the patent, the method disclosed is directed to the production of such alloys by forming a casting of a specified composition in which brittle rod-like intermetallic phases are present, following which the casting is mechanically worked to break up the rod-like phases and form separate particles which are dispersed through the mass. The patent states that when intermetallic particles of a size within the range of about 0.1 to 2 microns form from a 5 to 20% by volume of an aluminum alloy, the worked alloy possesses interesting mechanical properties. When the volume fraction of the phases falls below 5%, the mechanical properties are inferior, and that when they exceed 20 volume %, the ductility and toughness decline.

A similar disclosure appears in a sister application of the above-identified patent which issued as U.S. Pat. No. 4,126,486. This patent is directed to a method and product, the composition consisting essentially of 7–10% Si, up to 1% Cu, up to 1% Mg, up to 1% Mn and the balance aluminum, with up to a total of 1% residuals. The method comprises producing an aluminum-silicon alloy by continuous casting in the form of a thin slab at a growth rate of about 25 cm/min. so as to solidify silicon in the form of elongated rods of about 0.05 to 0.5 microns uniformly dispersed throughout the thickness of the slab. The slab is subjected to 60% reduction to fragment the silicon rods into finely divided separate particles and later cold-rolled to at least a final 10% reduction to final sheet form, following which the cold-rolled sheet is annealed at a temperature in the range of 250° C. to 400° C.

A disadvantage of the foregoing methods is the initial requirement of massively mechanically working the alloy to a reduction of at least 60% in order to fragment the hard silicon phase into fine particles.

We have discovered a method for producing wrought aluminum eutectic composites without first massively mechanically working the alloy to break up elongated intermetallic particles or phases to produce a fine dispersion thereof.

OBJECTS OF THE INVENTION

It is thus an object of the invention to provide a method for producing wrought aluminum eutectic composites using a thermal process for converting relatively large elongated phases into finely dispersed particles.

Another object is to provide a product produced by the method.

These and other objects will more clearly appear when taken in conjunction with the following disclosure, the claims and the appended drawings.

THE DRAWINGS

SUMMARY OF THE INVENTION

Figure 1:
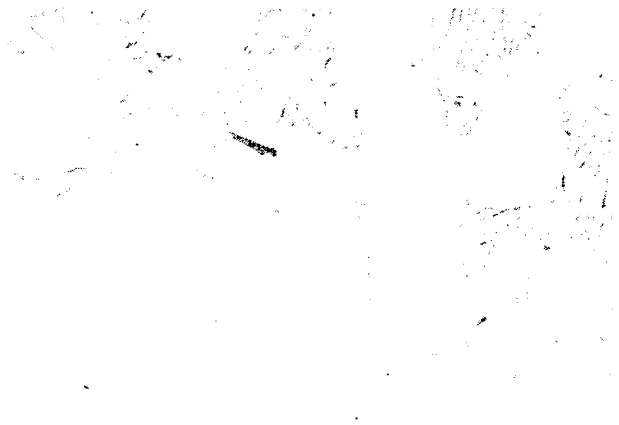
FIG. 1 is a photomicrograph of an as-cast Al-Si alloy containing by weight 10.1% Si taken at 500 times magnification.
Figure 2:
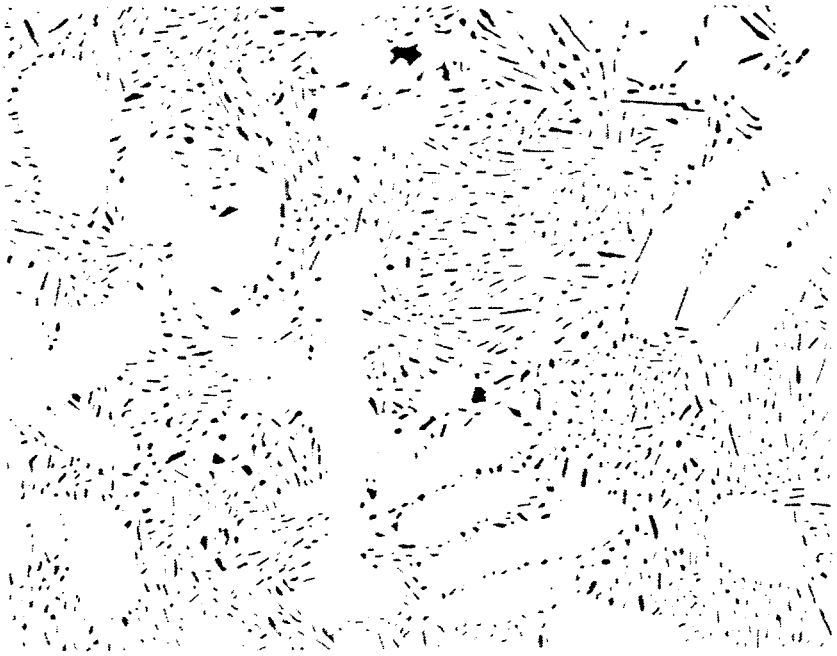
FIG. 2 is a photomicrograph taken at 200 times magnification of the same Al-Si alloy following 12 hours of heat treatment at 550° C.
Figure 3:
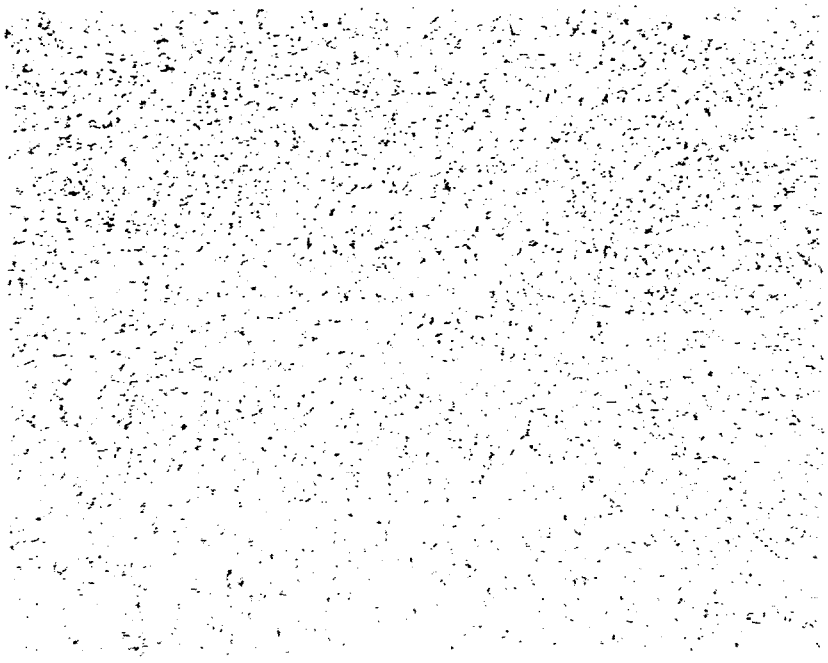
FIG. 3 is a photomicrograph taken at 100 times magnification of the alloy hot rolled following said heat treatment.
Figure 4:
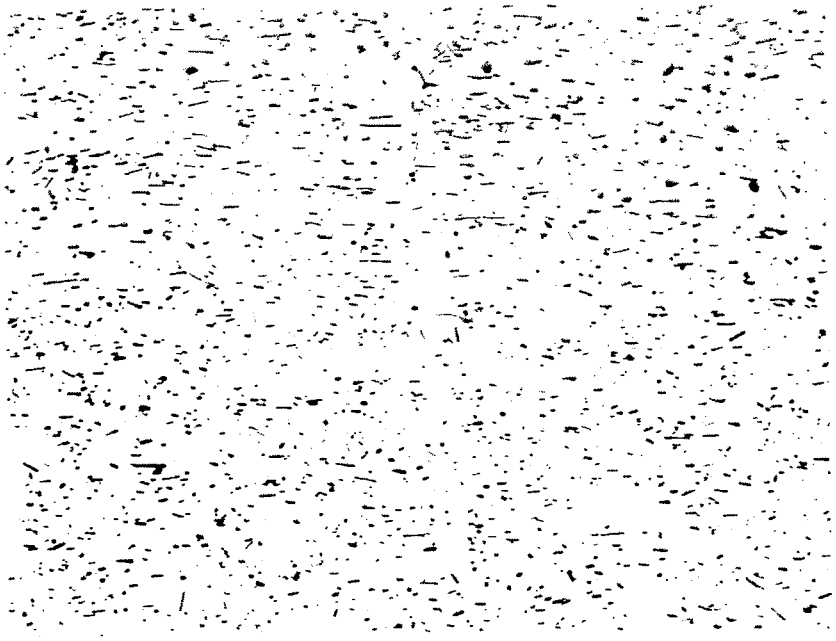
FIG. 4 is a photomicrograph taken at 200 times magnification of the alloy following heat treatment and which has been hot rolled and then cold rolled.

Stating it broadly, the invention is directed to a method for producing a wrought aluminum eutectic composite characterized by improved physical properties. The method comprises forming a casting of an aluminum alloy characterized metallographically by the presence of a eutectic structure, heat treating the casting at a temperature just below the eutectic-forming temperature of said alloy casting, preferably in the range of about 15° C. to 30° C. below the incipient melting point of the eutectic alloy, and continuing the heat treatment for a time at least sufficient (about 8 hrs to 16 hrs) to convert the morphology of said eutectic to finely dispersed particles of reinforcing phase(s). Following completion of the heat treatment, the alloy is then mechanically worked to reduce the cross section thereof and provide a wrought aluminum eutectic composite characterized by improved physical properties.

The processing employed in this invention for preparing wrought, aluminum eutectic, composites involves the steps of:

1. static or direct chill casting of ingot slabs or billets;
2. heat treatment of the cast material at a temperature below the eutectic temperature, e.g., twelve hours at the eutectic temperature ($T_e$) minus 25° C. to convert the cast structure, e.g., lamellae or needles, through solid state diffusion, and form fine particles of the reinforcing phase(s); and
3. hot rolling, warm rolling, and/or cold rolling or extrusion.

The heat treatment following casting is a very important feature of the invention. It enables the conversion of lamellae or needles or rods of the intermetallic compound or phase(s) into finely dispersed particles. As stated hereinabove, the temperature of heat treatment is controlled to between about 15° C. to about 30° C. below the incipient melting point of the eutectic alloy.

DETAILS OF THE INVENTION

The invention is particularly applicable to aluminum-base eutectic alloys selected from the group consisting of Al-Si, Al-Mg-Si, Al-Mn-Si, Al-Fe-Si and Al-Cu-Si.

The amount of solute in the alloy can range from below the eutectic-forming composition of the binary to above said composition. In the case of the Al-Si alloy, the silicon content may desirably be approximately 10 to 12% by weight, although the silicon content can range from about 7% to 13.5% by weight.

With regard to the ternary alloy Al-Mg-Si, the silicon content by weight may be approximately 4.75% and the magnesium content approximately 8.25%. Generally the silicon content may range from about 4% to 5.5% and the magnesium content from about 7.5% to 9%.

With respect to the Al-Mn-Si alloy, the silicon content may be approximately 12% by weight and the manganese content approximately 0.5 to 1.6%. Generally, the silicon content may range from about 1% to 13% by weight and manganese ranging from about 0.4% to 3%.

In the case of Al-Fe-Si ternary alloy, the iron content may range by weight from about 0.5% to 5% and the silicon content from about 6% to 13% by weight.

With regard to the Al-Cu-Si alloy system, the copper content may range by weight from about 8% to 30% and the silicon content from about 4% to 7%.

Preferably, the aluminum eutectic alloys are those in which the amount of secondary phase or intermetallic comprises about 5% to 20% by volume of the alloy.

Unlike the method disclosed in U.S. Pat. No. 3,989,548, the phases or intermetallics making up the eutectic are not broken up by massively mechanically working the alloy but, on the contrary, by employing a special heat treatment.

Another difference between the present invention and the aforementioned U.S. patent is that the concept disclosed in the U.S. patent requires the use of direct chill casting to achieve the stated objectives; whereas, the present invention is applicable to both static casting and/or direct chill casting.

Moreover, the aforementioned patent is directed to rolled products; whereas, the present invention is applicable to the treatment of products produced by any working technique.

The alloy is preferably produced as cast slabs and/or billets, the slabs/or billets heat treated as discussed hereinabove. Examples of specific compositions studied are given in Table 1 below.

TABLE 1

| Compositions of Eutectic Slabs in Wt - % | | | | | | |
|---|---|---|---|---|---|---|
| Alloy Systems | Al | Fe | Si | Cu | Mn | Mg |
| Al—Mg—Si | Bal. | 0.072 | 4.81 | | | 8.32 |
| Al—Si | Bal. | | 10.1 | | | |
| | Bal. | | 11.6 | | | |

TABLE 1-continued

| Compositions of Eutectic Slabs in Wt - % | | | | | | |
|---|---|---|---|---|---|---|
| Alloy Systems | Al | Fe | Si | Cu | Mn | Mg |
| Al—Mn—Si | Bal. | 0.385 | 12.2 | | 0.453 | |
| Al—Mn—Si (off)* | Bal. | 0.404 | 0.05 | | 1.59 | |
| Al—Fe—Si | Bal. | 0.937 | 11.9 | | | |
| Al—Fe—Si (off)* | Bal. | 3.76 | 7.71 | | | |
| Al—Cu—Si | Bal. | 0.272 | 5.07 | 24.7 | | |

*(off) - Not on the eutectic composition

Preparation of the Alloys

The compositions in Table 1 were produced as 19 kg (42 lb) heats of the aluminum eutectics of the present invention. The charge materials were 1100 and 6061 billets, common aluminum master alloys, elemental copper, and pure iron. Two ingots with dimensions 65 by 115 by 305 mm (2.5 by 4.5 by 12 in.) were prepared from each heat by induction melting in air and pouring into copper molds (with and without water cooling). The ingots were grain refined with tablets of titanium- and boron-containing salts. The heats were degassed with either donuts of hexachorethane and inert salts or a Freon-12/nitrogen gas mixture.

The ingots were preheated, generally for 12 hours at near the eutectic temperature to break up the phases and for fine dispersions and hot rolled as described in Table 2. Some plates were cold or warm rolled after hot rolling. Rolling reductions varied between 5 and 25% per pass. Extrusion blanks, 60 mm (2.375 in.) in diameter, were prepared from the ingots and extruded to 22 mm (0.875 in.) diameter bar using the temperatures shown in Table 2. The ram speed was nominally 1.5 m/min (60 in/min). Sections of commercially-cast 1100 and 6061 billet were also rolled and/or extruded Some of the alloys were subjected to a solution and aging treatment after thermomechanical processing.

The general characteristics of aluminum alloy eutectics are illustrated in Table 3, particularly the eutectic temperature against which the temperature of heat treatment is determined for modifying the morphology of the reinforcing phase in accordance with the invention.

TABLE 2

| Thermo Mechanical Processing | | | | | | |
|---|---|---|---|---|---|---|
| | Process | Thickness or Dia, in. Start | Thickness or Dia, in. Finish | Thickness Reduction (%) or Extrusion Ratio | Preheat Temp. °C. | Preheat Time hr. |
| 1100 | HR | 2.35 | 0.175 | 93 | 565 | 12 |
| | CR | 0.175 | 0.100 | 43 | | |

TABLE 2-continued

| Thermo Mechanical Processing | | | | | | |
|---|---|---|---|---|---|---|
| | Process | Thickness or Dia, in. Start | Thickness or Dia, in. Finish | Thickness Reduction (%) or Extrusion Ratio | Preheat Temp. °C. | Preheat Time hr. |
| | CR | 0.17 | 0.050 | 71 | | |
| 6061 | HR | 2.35 | 0.217 | 91 | 550 | 12 |
| | CR | 0.217 | 0.100 | 54 | | |
| | CR | 0.217 | 0.050 | 77 | | |
| | Ext. | 2.5 | 0.875 | 8.2:1 | 425 | 1 |
| Al—Mg—Si | HR | 2.35 | 0.65 | 72 | 450 | 2 |
| | HR | 2.35 | 0.21 | 91 | 450 | 2 |
| | HR | 2.35 | 0.06 | 97 | 450 | 2 |
| | WR | 0.65 | 0.025 | 96 | 300 | 1 |
| | WR | 0.61 | 0.15 | 75 | 300 | 1 |
| | CR | 0.15 | 0.015 | 90 | | |
| | CR | 0.06 | 0.015 | 75 | | |
| | Ext. | 2.5 | 0.875 | 8.2:1 | 450 | 2 |
| Al—Si | HR | 2.35 | 0.211 | 91 | 550 | 12 |
| | CR | 0.211 | 0.100 | 53 | | |
| | CR | 0.211 | 0.050 | 76 | | |
| Al—Mn—Si & | HR | 2.35 | 0.211 | 91 | 550 | 12 |
| Al—Mn—Si - off | CR | 0.21 | 0.050 | 76 | | |
| | Ext. | 2.5 | 0.875 | 8.2:1 | 550 | 12 |
| Al—Fe—Si | HR | 2.35 | 0.21 | 91 | 550 | 12 |
| | CR | 0.21 | 0.05 | 76 | | |
| | Ext. | 2.5 | 0.875 | 8.2:1 | 550 | 12 |
| Al—Fe—Si - off | Ext. | 2.5 | 0.875 | 8.2:1 | 485 | 12 |
| Al—Cu—Si | Ext. | 2.5 | 0.875 | 8.2:1 | 485 | 12 |

TABLE 3

| General Characteristics of Eutectics | | | |
|---|---|---|---|
| Alloy System | Phases in Eutectic (at Equilibrium) | Nominal Eutectic Composition | Eutectic Temperature, (°C./°F.) |
| Al—Mg—Si | (Al + $Mg_2Si$ | Al-8.25Mg-4.75Si | 595 (1103) |
| Al—Si | (Al) + (Si) | Al-12.6Si | 577 (1071) |
| Al—Mn—Si | (Al) + $\alpha$-$Al_{12}Mn_3Si_2$ + (Si) | Al-0.75Mn-12.5Si | 576 (1069) |
| Al—Mn—Si (off) | (Al) + $\alpha$-$Al_{12}Mn_3Si_2$ + (Si) | Al-1.6Mn-0.05Si | — |
| Al—Fe—Si | (Al) + $\beta$-$Al_9Si_2Fe_2$ + (Si) | Al-0.8Fe-12.3Si | 578 (1072) |
| Al—Fe—Si (off) | (Al) + $\beta$-$Al_9Si_2Fe_2$ + (Si)[a] | Al-3.8Fe-7.7Si | — |
| Al—Cu | (Al) + $\theta$-$Al_2Cu$ | Al-33.2Cu | 548 (1918) |
| Al—Cu—Mg | (Al) + $\theta$-$Al_2Cu$ + S—$Al_2CuMg$ | Al-33.1Cu-6Mg | 508 (946) |
| Al—Cu—Si | (Al) + $\theta$-$Al_2Cu$ + (Si) | Al-27Cu-5.25Si | 524 (975) |

[a]May contain some $\alpha$-$Al_{12}Fe_3Si_2$ as well.

The Microstructure

Optical micrographs of one of the Al-Si eutectic alloys, taken in the transverse orientation, are shown in FIGS. 1 to 4 for various conditions. After the heat treatment, the boundaries of the aluminum dendrites are less visible and particles have formed from the silicon needles After rolling, spherical particles varied in size between 2.5 and 10 microns. A few elongated particles (1:d=15:2.5 microns) were observed.

These observations are also typical of the ternary eutectic alloys which form intermetallic phases as well as the (Si) phase in the aluminum matrix as described in Table 3. In addition to the fine particles, larger polygonal-shaped particles were observed in the ternary eutectic microstructure. In contrast to the (Si) phase, the intermetallic phases were less affected by the heat treatment. The microstructures observed after extrusion were similar except that the interparticle spacings were smaller.

Room Temperature Tensile Properties

Figure 5:
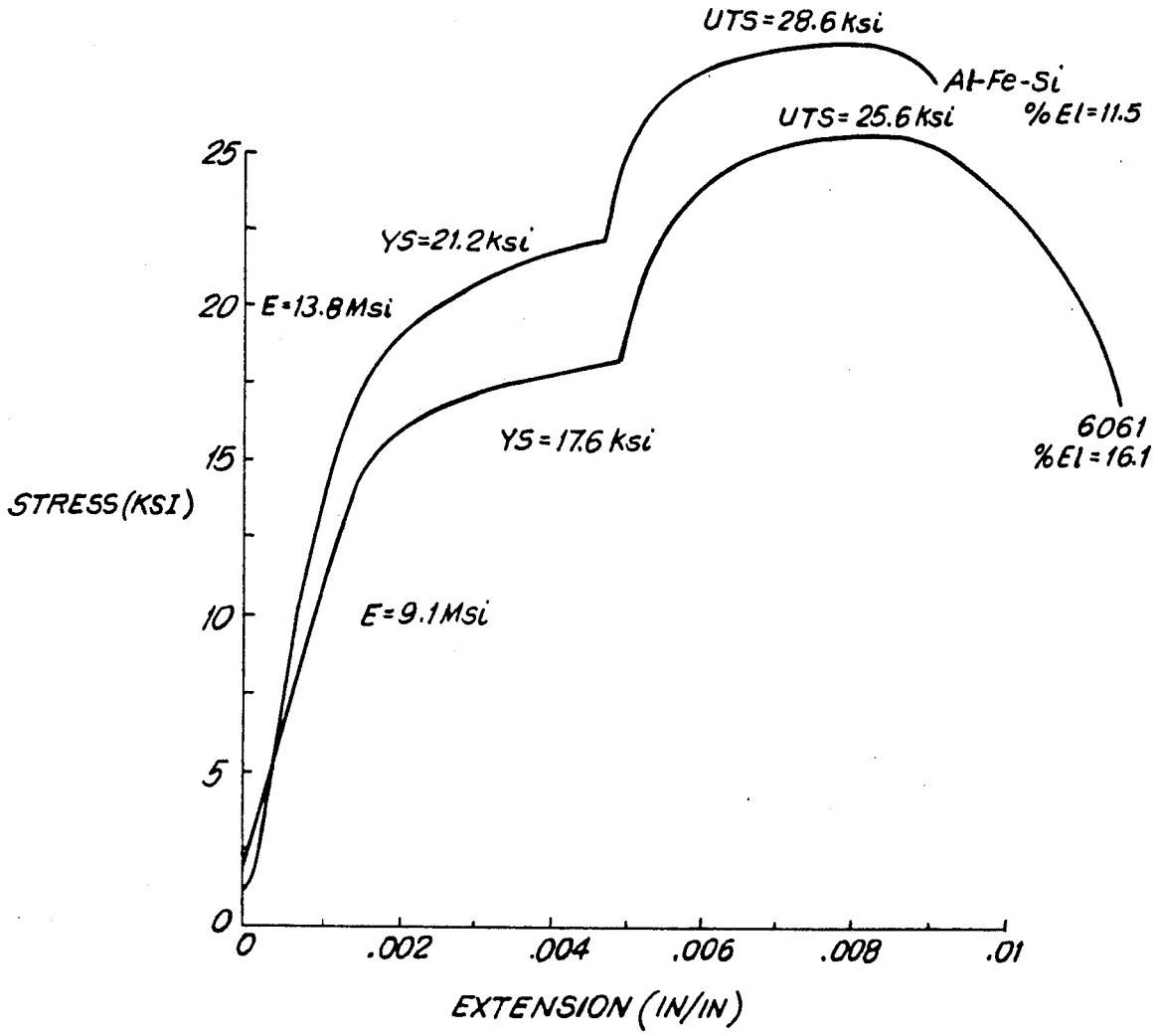
FIG. 5 depicts tensile curves comparing hot rolled (91% RT) 6061 with hot rolled Al-Fe-Si eutectic alloy produced in accordance with the invention.

Shown in FIG. 5 are typical room temperature stress-strain curves for one of the eutectics and for the 6061 alloy. Compared to commercial aluminum alloys, eutectic composites offer higher strength and modulus at comparable or slightly reduced ductility. Compared to ceramic-reinforced aluminum metal matrix composites, eutectic composites offer lower modulus and increased ductility at potentially lower cost.

An advantage of the invention is that the final product need not be back annealed to obtain ductility as is disclosed in U.S. Pat. No. 4,126,486 discussed hereinbefore. On the contrary, the wrought product produced by the invention can be used in the fabricated state without requiring annealing.

Tensile data for the eutectics in several conditions are ranked by yield strength, tensile strength, modulus, and ductility in Tables 4 through 7, respectively. Also included are tensile data from a commercial aluminum alloy handbook[1] and various Al-20 v/o SiC composite references. 1 ASM Metals Handbook, 9th Ed., Vol. 2, American Society For Metals, 1979.

In the solution treated and aged (S+A) condition, the Al-Mg-Si and Al-Cu-Si alloys have higher or equivalent strength to 2024-T6 and 6061-T6, greater strength than the non-heat treatable 3004 and 5252, and lower strength than 7075-T6. Several of the eutectics have 10 to 30% higher modulus than the commercial alloys, e.g., the hot rolled Al-Si eutectics aged (A) at 170° C. for 10 hours (See Table 6 hereinafter). When compared in the as-rolled condition, the eutectics have higher modulus and similar or slightly lower ductility than the commercial alloys, e.g., hot +cold rolled Al-Fe-Si versus 3004 and 5252 (See Table 6).

As will be clearly apparent from Table 6, the moduli of the eutectic alloys of the invention range from about 68 to 95 GPa.

For Al-Mg-Si, the solution treatment is 550° C., 3 hours, water quench, and the aging treatment is 175° C., 4 hours, and air cool. For Al-Cu-Si, the solution and aging treatment is 500° C., 3 hours, water quench, 175° C., 24 hours, and air cool.

Figure 6:
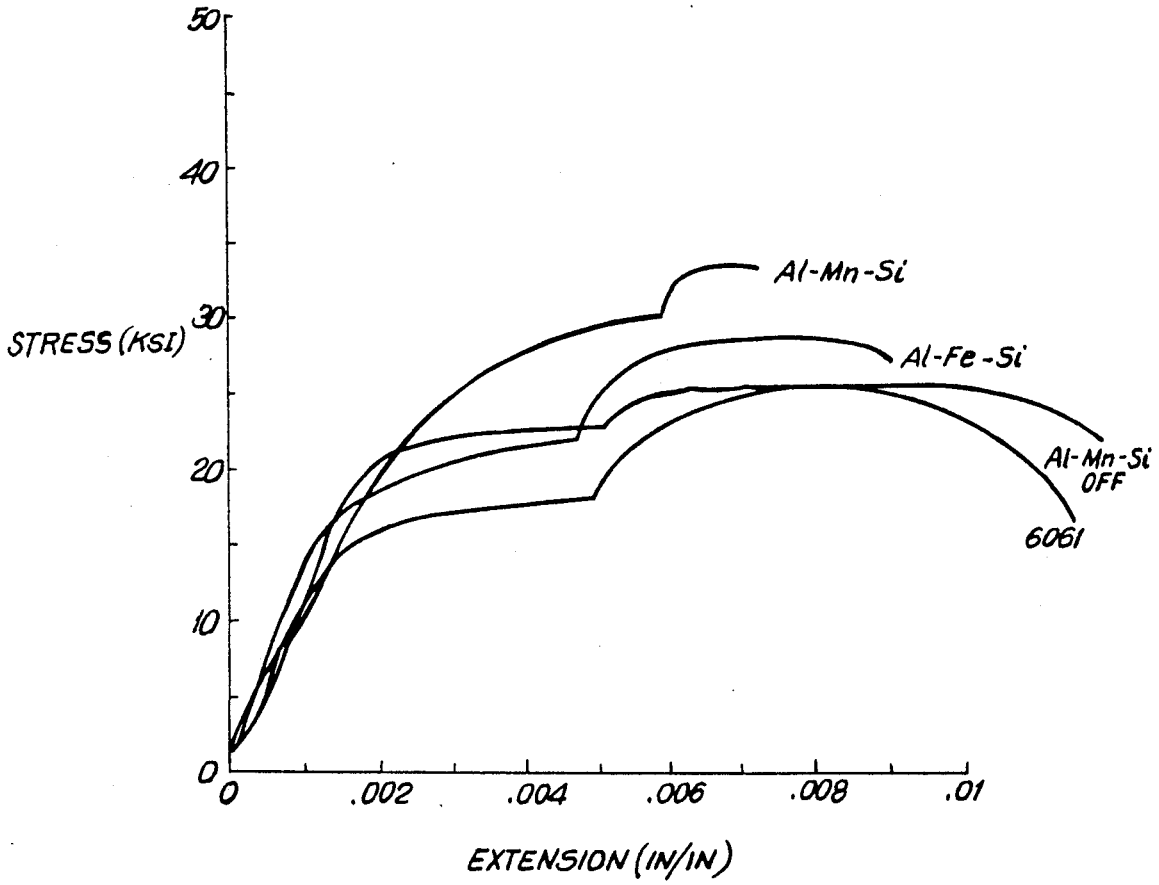
FIG. 6 depicts tensile curves for hot rolled (91% RT) 6061 and three eutectic alloys.
Figure 7:
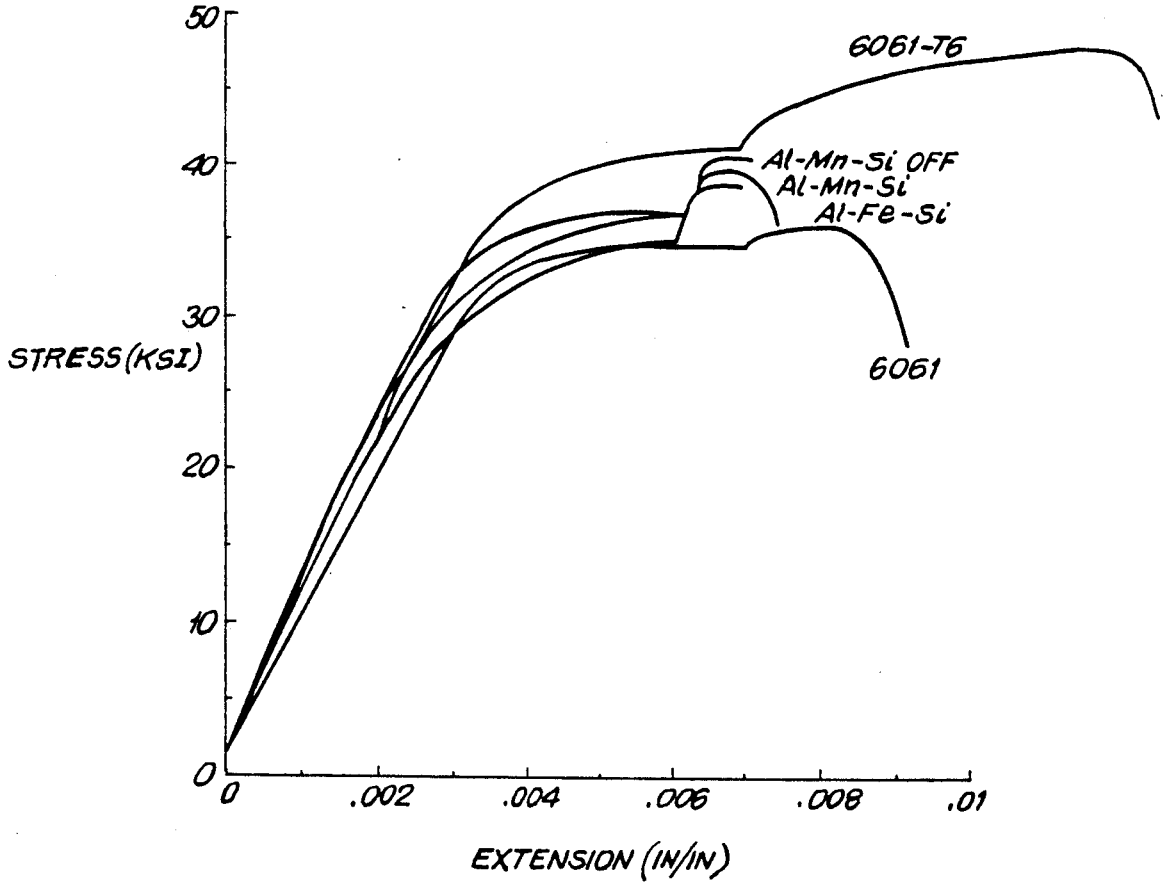
FIG. 7 shows a set of tensile curves comparing hot rolled (91% RT) and cold rolled (76% RT) 6061 and three eutectic alloys.
Figure 8:
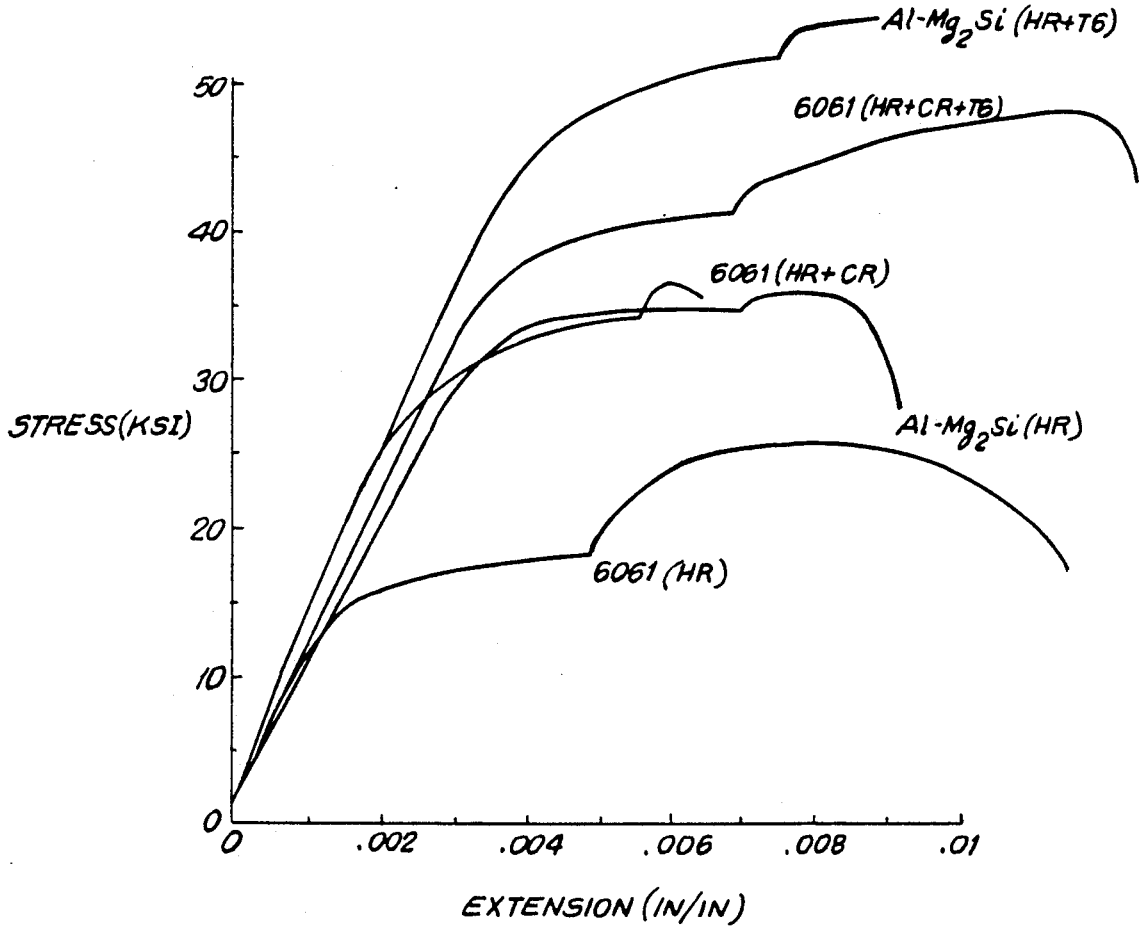
FIG. 8 is illustrative of tensile curves for hot rolled (91% RT) and cold rolled (76% RT) 6061 compared to hot rolled (91% RT) of Al-$Mg_2Si$ eutectic alloys.

As shown in FIGS. 6 and 7, the Al-Si-X eutectics generally have higher strength and lower ductility than 6061 processed similarly; however, when subjected to a T6 heat treatment, 6061 is superior to these non-heat treatable eutectic alloys. However, as shown in FIG. 8, the Al-$Mg_2Si$ eutectic requires less processing to achieve the same strength levels as 6061; the 6061 must be cold rolled to achieve the same strength as hot rolled Al-$Mg_2Si$.

TABLE 4

Materials Ranked by Yield Strength (YS)

| Alloy | Condition | Thick., in. | 0.2% YS MPa | 0.2% YS ksi | UTS MPa | UTS ksi | E GPa | E Msi | % El |
|---|---|---|---|---|---|---|---|---|---|
| 7075 | T6 - Handbook | | 503 | 73.0 | 572 | 83.0 | 71.0 | 10.3 | 11.0 |
| 6061 - SiC | Cast + Extruded + T6 | | 365 | 53.0 | 400 | 58.0 | 97.2 | 14.1 | 1.2 |
| 6061 - SiC | Cast + Pressed + T6 | | 365 | 53.0 | 421 | 61.0 | 106.9 | 15.5 | 2.5 |
| Al—Mg—Si | HR 91% + S + A | 0.200 | 345 | 50.1 | 368 | 53.4 | 80.3 | 11.6 | 5.0 |
| 2024 | T6 - Handbook | | 345 | 50.0 | 441 | 64.0 | 72.4 | 10.5 | 5.0 |
| 6061 - SiC | PM + Pressed + Extruded + Rolled + T6 | | 345 | 50.0 | 407 | 59.0 | 105.5 | 15.3 | 5.4 |
| Al—Cu—Si | Extruded 8.2:1 + S + A | | 337 | 48.9 | 380 | 55.1 | | | 1.4 |
| 6061 | Extruded 8.2:1 + T6 | | 291 | 42.3 | 325 | 47.1 | | | 19.8 |
| Al—Mg—Si | Extruded 8.2:1 + S + A | | 285 | 41.3 | 310 | 45.0 | | | 7.7 |
| 6061 | HR 91% + CR 77% + T6 | 0.050 | 278 | 40.3 | 328 | 47.6 | 74.1 | 10.8 | 16.1 |
| 6061 | T6 - Handbook | | 276 | 40.0 | 310 | 45.0 | 68.9 | 10.0 | 12.0 |
| Al—Mg—Si | HR 72% + WR 96% + S + A | 0.025 | 256 | 37.1 | 290 | 42.1 | | | 8.5 |
| Al—Mn—Si off | HR 91% + CR 76% | 0.050 | 252 | 36.5 | 273 | 39.6 | 79.3 | 11.5 | 4.1 |
| 6061 | HR 91% + CR 77% | 0.050 | 250 | 36.2 | 259 | 37.5 | 71.0 | 10.3 | 5.4 |
| Al—Cu—Si | Extruded 8.2:1 | | 249 | 36.2 | 292 | 42.3 | | | 2.2 |
| 3004 | H38 - Handbook | | 248 | 36.0 | 283 | 41.0 | 70.3 | 10.2 | 6.0 |
| Al—Fe—Si | HR 91% + CR 76% | 0.050 | 246 | 35.7 | 279 | 40.5 | 76.9 | 11.2 | 3.4 |
| 5252 | H38 + Handbook | | 241 | 35.0 | 283 | 41.0 | 68.3 | 9.9 | 5.0 |
| Al—Mn—Si | HR 91% + CR 76% | 0.050 | 235 | 34.2 | 269 | 39.0 | 77.6 | 11.3 | 3.4 |
| Al-12% Si | HR 91% + CR 76% | 0.050 | 215 | 31.2 | 266 | 38.6 | 72.0 | 10.5 | 6.5 |
| Al-10% Si | HR 91% + CR 76% | 0.050 | 210 | 30.5 | 252 | 36.6 | 74.5 | 10.8 | 6.6 |
| Al—Mg—Si | HR 91% | 0.200 | 208 | 30.1 | 232 | 33.6 | 79.6 | 11.6 | 3.3 |
| Al—Mn—Si | HR 91% | 0.211 | 201 | 29.2 | 234 | 33.9 | 72.4 | 10.5 | 4.2 |
| Al—Mg—Si | HR 72% + WR 96% + S | 0.025 | 165 | 24.0 | 266 | 38.6 | | | 10.8 |
| 1100 | HR 93% + CR 71% | 0.050 | 162 | 23.5 | 174 | 25.3 | 68.9 | 10.0 | 3.6 |
| Al—Mn—Si off | HR 91% | 0.212 | 156 | 22.7 | 179 | 25.9 | 85.1 | 12.4 | 16.3 |
| 1100 | H18 - Handbook | | 152 | 22.0 | 165 | 24.0 | 68.9 | 10.0 | 15.0 |
| 6061 | HR 91% - T5 | 0.217 | 149 | 21.6 | 192 | 27.9 | 77.7 | 11.3 | 12.6 |
| Al—Fe—Si | HR 91% | 0.208 | 147 | 21.3 | 196 | 28.4 | 91.7 | 13.3 | 10.2 |
| Al-12% Si | HR 91% | 0.211 | 134 | 19.4 | 185 | 26.9 | 67.6 | 9.8 | 11.4 |
| Al—Mg—Si | Extruded 8.2:1 | | 132 | 19.2 | 194 | 28.1 | | | 12.2 |
| Al-12% Si | HR 91% + A | 0.211 | 131 | 19.0 | 178 | 25.9 | 94.8 | 13.8 | 11.1 |
| 6061 | HR 91% | 0.217 | 126 | 18.3 | 176 | 25.6 | 64.1 | 9.3 | 14.8 |
| Al-10% Si | HR 91% + A | 0.211 | 124 | 18.1 | 172 | 24.9 | 93.8 | 13.6 | 15.0 |
| Al-10% Si | HR 91% | 0.211 | 124 | 18.0 | 175 | 25.5 | 77.6 | 11.3 | 16.3 |
| 7075 | O - Handbook | | 103 | 15.0 | 262 | 38.0 | 71.0 | 10.3 | 17.0 |
| 6061 | Extruded 8.2:1 | | 103 | 14.9 | 156 | 22.7 | | | 28.4 |
| 1100 | HR 93% | 0.175 | 98 | 14.2 | 115 | 16.6 | 77.2 | 11.2 | 15.1 |
| Al—Fe—Si off | Extruded 8.2:1 | | 91 | 13.3 | 136 | 19.7 | | | 9.4 |
| Al—Mn—Si off | Extruded 8.2:1 | | 90 | 13.0 | 178 | 25.8 | | | 26.5 |
| 2024 | O - Handbook | | 76 | 11.0 | 186 | 27.0 | 72.4 | 10.5 | 20.0 |
| Al—Fe—Si | Extruded 8.2:1 | | 75 | 10.9 | 171 | 24.9 | | | 24.8 |
| Al—Mn—Si | Extruded 8.2:1 | | 72 | 10.4 | 158 | 23.0 | | | 20.4 |

TABLE 5

Materials Ranked By Ultimate Tensile Strength (UTS)

| Alloy | Condition | Thick., in. | 0.2% YS MPa | 0.2% YS ksi | UTS MPa | UTS ksi | E GPa | E Msi | % El |
|---|---|---|---|---|---|---|---|---|---|
| 7075 | T6 - Handbook | | 503 | 73.0 | 572 | 83.0 | 71.0 | 10.3 | 11.0 |
| 2024 | T6 - Handbook | | 345 | 50.0 | 441 | 64.0 | 72.4 | 10.5 | 5.0 |
| 6061 - SiC | Cast + Pressed + T6 | | 365 | 53.0 | 421 | 61.0 | 106.9 | 15.5 | 2.5 |
| 6061 - SiC | PM + Pressed + Extruded + Rolled + T6 | | 345 | 50.0 | 407 | 59.0 | 105.5 | 15.3 | 5.4 |
| 6061 - SiC | Cast + Extruded + T6 | | 365 | 53.0 | 400 | 58.0 | 97.2 | 14.1 | 1.2 |
| Al—Cu—Si | Extruded 8.2:1 + S + A | | 337 | 48.9 | 380 | 55.1 | | | 1.4 |
| Al—Mg—Si | HR 91% + S + A | 0.200 | 345 | 50.1 | 368 | 53.4 | 80.3 | 11.6 | 5.0 |
| 6061 | HR 91% + CR 77% + T6 | 0.050 | 278 | 40.3 | 328 | 47.6 | 74.1 | 10.8 | 16.1 |
| 6061 | Extruded 8.2:1 + T6 | | 291 | 42.3 | 325 | 47.1 | | | 19.8 |
| 6061 | T6 - Handbook | | 276 | 40.0 | 310 | 45.0 | 68.9 | 10.0 | 12.0 |
| Al—Mg—Si | Extruded 8.2:1 + S + A | | 285 | 41.3 | 310 | 45.0 | | | 7.7 |
| Al—Cu—Si | Extruded 8.2:1 | | 249 | 36.2 | 292 | 42.3 | | | 2.2 |
| Al—Mg—Si | HR 72% + WR 96% + S + A | 0.025 | 256 | 37.1 | 290 | 42.1 | | | 8.5 |
| 3004 | H38 - Handbook | | 248 | 36.0 | 283 | 41.0 | 70.3 | 10.2 | 6.0 |
| 5252 | H38 - Handbook | | 241 | 35.0 | 283 | 41.0 | 68.3 | 9.9 | 5.0 |
| Al—Fe—Si | HR 91% + CR 76% | 0.050 | 246 | 35.7 | 279 | 40.5 | 76.9 | 11.2 | 3.4 |
| Al—Mn—Si off | HR 91% + CR 76% | 0.050 | 252 | 36.5 | 273 | 39.6 | 79.3 | 11.5 | 4.1 |
| Al—Mn—Si | HR 91% + CR 76% | 0.050 | 235 | 34.2 | 269 | 39.0 | 77.6 | 11.3 | 3.4 |
| Al-12% Si | HR 91% + CR 76% | 0.050 | 215 | 31.2 | 266 | 38.6 | 72.0 | 10.5 | 6.5 |
| Al—Mg—Si | HR 72% + WR 96% + S | 0.025 | 165 | 24.0 | 266 | 38.6 | | | 10.8 |
| 7075 | O - Handbook | | 103 | 15.0 | 262 | 38.0 | 71.0 | 10.3 | 17.0 |
| 6061 | HR 91% + CR 77% | 0.050 | 250 | 36.2 | 259 | 37.5 | 71.0 | 10.3 | 5.4 |
| Al-10% Si | HR 91% + CR 76% | 0.050 | 210 | 30.5 | 252 | 36.6 | 74.5 | 10.8 | 6.6 |
| Al—Mn—Si | HR 91% | 0.211 | 201 | 29.2 | 234 | 33.9 | 72.4 | 10.5 | 4.2 |
| Al—Mg—Si | HR 91% | 0.200 | 208 | 30.1 | 232 | 33.6 | 79.6 | 11.6 | 3.3 |
| Al—Fe—Si | HR 91% | 0.208 | 147 | 21.3 | 196 | 28.4 | 91.7 | 13.3 | 10.2 |
| Al—Mg—Si | Extruded 8.2:1 | | 132 | 19.2 | 194 | 28.1 | | | 12.2 |
| 6061 | HR 91% - T5 | 0.217 | 149 | 21.6 | 192 | 27.9 | 77.7 | 11.3 | 12.6 |
| 2024 | O - Handbook | | 76 | 11.0 | 186 | 27.0 | 72.4 | 10.5 | 20.0 |
| Al-12% Si | HR 91% | 0.211 | 134 | 19.4 | 185 | 26.9 | 67.6 | 9.8 | 11.4 |
| Al—Mn—Si off | HR 91% | 0.212 | 156 | 22.7 | 179 | 25.9 | 85.1 | 12.4 | 16.3 |
| Al-12% Si | HR 91% + A | 0.211 | 131 | 19.0 | 178 | 25.9 | 94.8 | 13.8 | 11.1 |
| Al—Mn—Si off | Extruded 8.2:1 | | 90 | 13.0 | 178 | 25.8 | | | 26.5 |
| 6061 | HR 91% | 0.217 | 126 | 18.3 | 176 | 25.6 | 64.1 | 9.3 | 14.8 |
| Al-10% Si | HR 91% | 0.211 | 124 | 18.0 | 175 | 25.5 | 77.6 | 11.3 | 16.3 |
| 1100 | HR 93% + CR 71% | 0.050 | 162 | 23.5 | 174 | 25.3 | 68.9 | 10.0 | 3.6 |
| Al-10% Si | HR 91% + A | 0.211 | 124 | 18.1 | 172 | 24.9 | 93.8 | 13.6 | 15.0 |
| Al—Fe—Si | Extruded 8.2:1 | | 75 | 10.9 | 171 | 24.9 | | | 24.8 |
| 1100 | H18 - Handbook | | 152 | 22.0 | 165 | 24.0 | 68.9 | 10.0 | 15.0 |
| Al—Mn—Si | Extruded 8.2:1 | | 72 | 10.4 | 158 | 23.0 | | | 20.4 |
| 6061 | Extruded 8.2:1 | | 103 | 14.9 | 156 | 22.7 | | | 28.4 |
| Al—Fe—Si off | Extruded 8.2:1 | | 91 | 13.3 | 136 | 19.7 | | | 9.4 |
| 1100 | HR 93% | 0.175 | 98 | 14.2 | 115 | 16.6 | 77.2 | 11.2 | 15.1 |

TABLE 6

Materials Ranked by Elastic Modulus (E)

| Alloy | Condition | Thick., in. | 0.2% YS MPa | 0.2% YS ksi | UTS MPa | UTS ksi | E GPa | E Msi | % El |
|---|---|---|---|---|---|---|---|---|---|
| 6061 - SiC | Cast + Pressed + T6 | | 365 | 53.0 | 421 | 61.0 | 106.9 | 15.5 | 2.5 |
| 6061 - SiC | PM + Pressed + Extruded + Rolled + T6 | | 345 | 50.0 | 407 | 59.0 | 105.5 | 15.3 | 5.4 |
| 6061 - SiC | Cast + Extruded + T6 | | 365 | 53.0 | 400 | 58.0 | 97.2 | 14.1 | 1.2 |
| Al-12% Si | HR 91% + A | 0.211 | 131 | 19.0 | 178 | 25.9 | 94.8 | 13.8 | 11.1 |
| Al-10% Si | HR 91% + A | 0.211 | 124 | 18.1 | 172 | 24.9 | 93.8 | 13.6 | 15.0 |
| Al—Fe—Si | HR 91% | 0.208 | 147 | 21.3 | 196 | 28.4 | 91.7 | 13.3 | 10.2 |
| Al—Mn—Si off | HR 91% | 0.212 | 156 | 22.7 | 179 | 25.9 | 85.1 | 12.4 | 16.3 |
| Al—Mg—Si | HR 91% + S + A | 0.200 | 345 | 50.1 | 368 | 53.4 | 80.3 | 11.6 | 5.0 |
| Al—Mg—Si | HR 91% | 0.200 | 208 | 30.1 | 232 | 33.6 | 79.6 | 11.6 | 3.3 |
| Al—Mn—Si off | HR 91% + CR 76% | 0.050 | 252 | 36.5 | 273 | 39.6 | 79.3 | 11.5 | 4.1 |
| 6061 | HR 91% - T5 | 0.217 | 149 | 21.6 | 192 | 27.9 | 77.7 | 11.3 | 12.6 |
| Al-10% Si | HR 91% | 0.211 | 124 | 18.0 | 175 | 25.5 | 77.6 | 11.3 | 16.3 |
| Al—Mn—Si | HR 91% + CR 76% | 0.050 | 235 | 34.2 | 269 | 39.0 | 77.6 | 11.3 | 3.4 |
| 1100 | HR 93% | 0.175 | 98 | 14.2 | 115 | 16.6 | 77.2 | 11.2 | 15.1 |
| Al—Fe—Si | HR 91% + CR 76% | 0.050 | 246 | 35.7 | 279 | 40.5 | 76.9 | 11.2 | 3.4 |
| Al-10% Si | HR 91% + CR 76% | 0.050 | 210 | 30.5 | 252 | 36.6 | 74.5 | 10.8 | 6.6 |
| 6061 | HR 91% + CR 77% + T6 | 0.050 | 278 | 40.3 | 328 | 47.6 | 74.1 | 10.8 | 16.1 |
| 2024 | O - Handbook | | 76 | 11.0 | 186 | 27.0 | 72.4 | 10.5 | 20.0 |
| 2024 | T6 - Handbook | | 345 | 50.0 | 441 | 64.0 | 72.4 | 10.5 | 5.0 |
| Al—Mn—Si | HR 91% | 0.211 | 201 | 29.2 | 234 | 33.9 | 72.4 | 10.5 | 4.2 |
| Al-12% Si | HR 91% + CR 76% | 0.050 | 215 | 31.2 | 266 | 38.6 | 72.0 | 10.5 | 6.5 |
| 7075 | O - Handbook | | 103 | 15.0 | 262 | 38.0 | 71.0 | 10.3 | 17.0 |
| 7075 | T6 - Handbook | | 503 | 73.0 | 572 | 83.0 | 71.0 | 10.3 | 11.0 |
| 6061 | HR 91% + CR 77% | 0.050 | 250 | 36.2 | 259 | 37.5 | 71.0 | 10.3 | 5.4 |
| 3004 | H38 - Handbook | | 248 | 36.0 | 283 | 41.0 | 70.3 | 10.2 | 6.0 |
| 1100 | H18 - Handbook | | 152 | 22.0 | 165 | 24.0 | 68.9 | 10.0 | 15.0 |
| 6061 | T6 - Handbook | | 276 | 40.0 | 310 | 45.0 | 68.9 | 10.0 | 12.0 |
| 1100 | HR 93% + CR 71% | 0.050 | 162 | 23.5 | 174 | 25.3 | 68.9 | 10.0 | 3.6 |

TABLE 6-continued

Materials Ranked by Elastic Modulus (E)

| Alloy | Condition | Thick., in. | 0.2% YS MPa | 0.2% YS ksi | UTS MPa | UTS ksi | E GPa | E Msi | % El |
|---|---|---|---|---|---|---|---|---|---|
| 5252 | H38 - Handbook | | 241 | 35.0 | 283 | 41.0 | 68.3 | 9.9 | 5.0 |
| Al-12% Si | HR 91% | 0.211 | 134 | 19.4 | 185 | 26.9 | 67.6 | 9.8 | 11.4 |
| 6061 | HR 91% | 0.217 | 126 | 18.3 | 176 | 25.6 | 64.1 | 9.3 | 14.8 |

TABLE 7

Materials Ranked by Percent Elongation (% E)

| Alloy | Condition | Thick., in. | 0.2% YS MPa | 0.2% YS ksi | UTS MPa | UTS ksi | E GPa | E Msi | % El |
|---|---|---|---|---|---|---|---|---|---|
| 6061 | Extruded 8.2:1 | | 103 | 14.9 | 156 | 22.7 | | | 28.4 |
| Al—Mn—Si off | Extruded 8.2:1 | | 90 | 13.0 | 178 | 25.8 | | | 26.5 |
| Al—Fe—Si | Extruded 8.2:1 | | 75 | 10.9 | 171 | 24.9 | | | 24.8 |
| Al—Mn—Si | Extruded 8.2:1 | | 72 | 10.4 | 158 | 23.0 | | | 20.4 |
| 2024 | O - Handbook | | 76 | 11.0 | 186 | 27.0 | 72.4 | 10.5 | 20.0 |
| 6061 | Extruded 8.2:1 + T6 | | 291 | 42.3 | 325 | 47.1 | | | 19.8 |
| 7075 | O - Handbook | | 103 | 15.0 | 262 | 38.0 | 71.0 | 10.3 | 17.0 |
| Al-10% Si | HR 91% | 0.211 | 124 | 18.0 | 175 | 25.5 | 77.6 | 11.3 | 16.3 |
| Al—Mn—Si off | HR 91% | 0.212 | 156 | 22.7 | 179 | 25.9 | 85.1 | 12.4 | 16.3 |
| 6061 | HR 91% + CR 77% + T6 | 0.050 | 278 | 40.3 | 328 | 47.6 | 74.1 | 10.8 | 16.1 |
| 1100 | HR 93% | 0.175 | 98 | 14.2 | 115 | 16.6 | 77.2 | 11.2 | 15.1 |
| Al-10% Si | HR 91% + A | 0.211 | 124 | 18.1 | 172 | 24.9 | 93.8 | 13.6 | 15.0 |
| 1100 | H18 - Handbook | | 152 | 22.0 | 165 | 24.0 | 68.9 | 10.0 | 15.0 |
| 6061 | HR 91% | 0.217 | 126 | 18.3 | 176 | 25.6 | 64.1 | 9.3 | 14.8 |
| 6061 | HR 91% - T5 | 0.217 | 149 | 21.6 | 192 | 27.9 | 77.7 | 11.3 | 12.6 |
| Al—Mg—Si | Extruded 8.2:1 | | 132 | 19.2 | 194 | 28.1 | | | 12.2 |
| 6061 | T6 - Handbook | | 276 | 40.0 | 310 | 45.0 | 68.9 | 10.0 | 12.0 |
| Al-12% Si | HR 91% | 0.211 | 134 | 19.4 | 185 | 26.9 | 67.6 | 9.8 | 11.4 |
| Al-12% Si | HR 91% + A | 0.211 | 131 | 19.0 | 178 | 25.9 | 94.8 | 13.8 | 11.1 |
| 7075 | T6 - Handbook | | 503 | 73.0 | 572 | 83.0 | 71.0 | 10.3 | 11.0 |
| Al—Mg—Si | HR 72% + WR 96% + S | 0.025 | 165 | 24.0 | 266 | 38.6 | | | 10.8 |
| Al—Fe—Si | HR 91% | 0.208 | 147 | 21.3 | 196 | 28.4 | 91.7 | 13.3 | 10.2 |
| Al—Fe—Si off | Extruded 8.2:1 | | 91 | 13.3 | 136 | 19.7 | | | 9.4 |
| Al—Mg—Si | HR 72% + WR 96% + S + A | 0.025 | 256 | 37.1 | 290 | 42.1 | | | 8.5 |
| Al—Mg—Si | Extruded 8.2:1 + S + A | | 285 | 41.3 | 310 | 45.0 | | | 7.7 |
| Al-10% Si | HR 91% + CR 76% | 0.050 | 210 | 30.5 | 252 | 36.6 | 74.5 | 10.8 | 6.6 |
| Al-12% Si | HR 91% + CR 76% | 0.050 | 215 | 31.2 | 266 | 38.6 | 72.0 | 10.5 | 6.5 |
| 3004 | H38 - Handbook | | 248 | 36.0 | 283 | 41.0 | 70.3 | 10.2 | 6.0 |
| 6061 - SiC | PM + Pressed + Extruded + Rolled + T6 | | 345 | 50.0 | 407 | 59.0 | 105.5 | 15.3 | 5.4 |
| 6061 | HR 91% + CR 77% | 0.050 | 250 | 36.2 | 259 | 37.5 | 71.0 | 10.3 | 5.4 |
| 2024 | T6 - Handbook | | 345 | 50.0 | 441 | 64.0 | 72.4 | 10.5 | 5.0 |
| Al—Mg—Si | HR 91% + S + A | 0.200 | 345 | 50.1 | 368 | 53.4 | 80.3 | 11.6 | 5.0 |
| 5252 | H38 - Handbook | | 241 | 35.0 | 283 | 41.0 | 68.3 | 9.9 | 5.0 |
| Al—Mn—Si | HR 91% | 0.211 | 201 | 29.2 | 234 | 33.9 | 72.4 | 10.5 | 4.2 |
| Al—Mn—Si off | HR 91% + CR 76% | 0.050 | 252 | 36.5 | 273 | 39.6 | 79.3 | 11.5 | 4.1 |
| 1100 | HR 93% + CR 71% | 0.050 | 162 | 23.5 | 174 | 25.3 | 68.9 | 10.0 | 3.6 |
| Al—Mn—Si | HR 91% + CR 76% | 0.050 | 235 | 34.2 | 269 | 39.0 | 77.6 | 11.3 | 3.4 |
| Al—Fe—Si | HR 91% + CR 76% | 0.050 | 246 | 35.7 | 279 | 40.5 | 76.9 | 11.2 | 3.4 |
| Al—Mg—Si | HR 91% | 0.200 | 208 | 30.1 | 232 | 33.6 | 79.6 | 11.6 | 3.3 |
| 6061 - SiC | Cast + Pressed + T6 | | 365 | 53.0 | 421 | 61.0 | 106.9 | 15.5 | 2.5 |
| Al—Cu—Si | Extruded 8.2:1 | | 249 | 36.2 | 292 | 42.3 | | | 2.2 |
| Al—Cu—Si | Extruded 8.2:1 + S + A | | 337 | 48.9 | 380 | 55.1 | | | 1.4 |
| 6061 - SiC | Cast + Extruded + T6 | | 365 | 53.0 | 400 | 58.0 | 97.2 | 14.1 | 1.2 |

In the T6 condition, the cast SiC-reinforced metal matrix composites have higher modulus and lower ductility at roughly comparable strength to solution treated and aged Al-Mg-Si hot rolled to 91% reduction. In the T6 condition, the powder metallurgical (PM) composite does have comparable ductility to the hot rolled Al-$Mg_2Si$ eutectic, but only after the PM material was subjected to several (expensive) processing steps, i.e., hot pressed, extruded, and cross-rolled The eutectics will possess densities based on (1) their solute content, which is high versus most commercial alloys, (2) the content of elements with densities less than that of aluminum, and (3) the chemistry of the intermetallic phases(s). Most of the eutectics that are the subject of this invention had a density near that of pure aluminum and commercial aluminum alloys (2.7 g/cm$^3$). However, the Al-Mg-Si and Al-Cu-Si alloys had densities of 2.56 and 3.3 g/cm$^3$, respectively.

For many applications, the specific strength and modulus are important for saving weight while maintaining structural integrity. Therefore, the properties of the standard aluminum alloys, the eutectic composites, and the ceramic-reinforced MMC should all be compared after dividing the pressure units by density. On this basis, a modulus superiority of 11.5% of hot rolled Al-$Mg_2Si$ versus 6061 would convert to 12.1% superiority in specific modulus, i.e., modulus normalized by density. Although the PM Al-SiC composite has a 106 GPa modulus that is 32% greater than the 80 GPa modulus of the Al-$Mg_2Si$ eutectic, the latter has significantly (12%) lower density. Therefore, the density normalized modulus of the Al-SiC composite is only 15% greater than that of the Al-$Mg_2Si$ composite.

From a density normalized strength standpoint, the Al-$Mg_2Si$ eutectic composite is stronger than both 6061 and Al-SiC. In the S+A condition (solution treated followed by aging), the Al-$Mg_2Si$ eutectic has a 32% and 13% higher specific yield strength and a 19% and 2% higher specific tensile strength than 6061 and Al-SiC, respectively.

Superplasticity

Hot or hot+warm rolled Al-$Mg_2Si$ produced in accordance with the invention, annealed for 1 hour at 450° C. in a salt pot, exhibited superplastic forming capability. Failure elongations of up to 280% were observed in tensile tests conducted at 550° C. and 0.002 $sec^{-1}$ strain rate. This strain rate represents a fivefold increase over the rate used to superplasticly form commercial alloy 7475 at similar temperatures. Others have observed even higher failure elongations for Al-$Mg_2Si$ eutectics.

Thus, in summary, superplasticity can be achieved following working of the aluminum eutectic alloy by annealing the wrought alloy at a temperature of approximately 450° C. for a time at least sufficient to convert the alloy to the superplastic state.

Although the present invention has been described in conjunction with preferred embodiment, it is to be understood that modifications and variations may be resorted to without departing from the spirit and scope of the invention, as those skilled in the art will readily understand. Such modifications and variations are considered to be within the purview and scope of the invention and appended claims.

What is claimed is:

1. A method for producing a wrought aluminum eutectic composite characterized by improved physical properties which comprises:

forming a casting of an aluminum alloy characterized metallographically by the presence of a eutectic structure, heat treating said casting at a temperature related to the eutectic-forming temperature of said alloy casting, said heat treating temperature being just below the eutectic-forming temperature, continuing said heat treatment for a time at least sufficient to convert the morphology of said eutectic to dispersed fine particles of reinforcing phase(s), and then physically working said heat treated casting to reduce the cross section thereof and provide a wrought aluminum eutectic composite characterized by improved physical properties.

2. The method of claim 1, wherein the heat treating temperature ranges from about 15° C. to 30° C. below the incipient melting point of said eutectic alloy.

3. The method of claim 2, wherein said alloy is heat treated for a time ranging from about 8 hrs to 16 hrs.

4. The method of claim 1, wherein the aluminum eutectic alloy is selected from the group consisting of Al-Si, Al-Mg-Si, Al-Mn-Si, Al-Fe-Si and Al-Cu-Si.

5. The method of claim 4, wherein the composition of each of said eutectic alloys by weight are as follows:

(1) about 7% to 13.5% Si, and the balance essentially Al;

(2) about 4% to 5.5% Si, about 7.5% to 9% Mg, and the balance essentially Al;

(3) about 0.4% to 3% Mn, about 6% to 13% Si, and the balance essentially Al;

(4) about 0.5% to 5.0% Fe, about 6% to 13% Si, and the balance essentially Al; and (5) about 8% to 30% Cu, about 4% to 7% Si, and the balance essentially Al.

6. A method for producing a superplastic wrought aluminum eutectic composite characterized by improved physical properties which comprises:

forming a casting of an aluminum alloy characterized metallographically by the presence of a eutectic structure, heat treating said casting at a temperature related to the eutectic-forming temperature of said alloy casting, said heat treating temperature ranging from about 15° C. to 30° C. below the incipient melting point of said eutectic alloy, continuing said heat treatment for a time at least sufficient to convert the morphology of said eutectic to dispersed fine particles of reinforcing phase(s), physically working said heat treated casting to reduce the cross section thereof and provide a wrought aluminum eutectic composite characterized by improved physical properties, and annealing the wrought aluminum eutectic alloy at a temperature of approximately 450° C. for a time at least sufficient to convert the alloy to the superplastic state.

7. The method of claim 6, wherein the aluminum alloy is selected from the group consisting of:

(1) about 7% to 13.5% Si, and the balance essentially Al;

(2) about 4% to 5.5% Si, about 7.5% to 9% Mg, and the balance essentially Al;

(3) about 0.4% to 3% Mn, about 6% to 13% Si, and the balance essentially Al;

(4) about 0.5% to 5.0% Fe, about 6% to 13% Si, and the balance essentially Al; and (5) about 8% to 30% Cu, about 4% to 7% Si, and the balance essentially Al.

* * * * *